US006794819B2

(12) United States Patent
Kao et al.

(10) Patent No.: US 6,794,819 B2
(45) Date of Patent: Sep. 21, 2004

(54) ELECTRODE STRUCTURE WITH WHITE BALANCE ADJUSTMENT

(75) Inventors: Hsu-Pin Kao, Taoyuan (TW); Yen-Ting Shen, Taipei (TW); Yi-Sheng Yu, Taoyuan (TW); Ching-Hui Lin, Taoyuan (TW); Kuang-Lang Chen, Taoyuan (TW)

(73) Assignee: Chunghwa Picture Tubes, Ltd. (TW)

( * ) Notice: Subject to any disclaimer, the term of this patent is extended or adjusted under 35 U.S.C. 154(b) by 18 days.

(21) Appl. No.: 10/315,541

(22) Filed: Dec. 10, 2002

(65) Prior Publication Data

US 2004/0000869 A1 Jan. 1, 2004

(30) Foreign Application Priority Data

Jun. 27, 2002 (TW) ..... 91114231 A

(51) Int. Cl.[7] ..... H01J 17/49

(52) U.S. Cl. ..... 313/582; 313/587; 313/585

(58) Field of Search ..... 313/582–587

(56) References Cited

U.S. PATENT DOCUMENTS

| | | | | |
|---|---|---|---|---|
| 6,348,762 | B1 * | 2/2002 | Nunomura et al. | 313/582 |
| 6,479,932 | B1 * | 11/2002 | Nunomura | 313/582 |
| 6,531,819 | B1 * | 3/2003 | Nakahara et al. | 313/584 |
| 2002/0008475 | A1 * | 1/2002 | Yoshioka et al. | 313/586 |
| 2002/0084752 | A1 * | 7/2002 | Yoshioka et al. | 313/584 |

* cited by examiner

*Primary Examiner*—Vip Patel
*Assistant Examiner*—German Colón
(74) *Attorney, Agent, or Firm*—Hayes Soloway P.C.

(57) ABSTRACT

An electrode structure with white balance adjustment for plasma display panel is described. The electrode structure has a comb electrode, a first transparent electrode and a second transparent electrode. The first transparent electrode and the second transparent electrode are separated from the comb electrode, respectively. Changing the profile of the first transparent electrode and the second transparent electrode increases the flexibility of the transparent electrodes. Further, the width of the first electrodes responsive to the luminous regions is adjusted to control the luminance through the first transparent electrode so that white balance of the plasma display panel is precisely corrected.

6 Claims, 2 Drawing Sheets

ELECTRODE STRUCTURE WITH WHITE BALANCE ADJUSTMENT

FIELD OF THE INVENTION

The present invention generally relates to an electrode structure, and more particularly, to an electrode structure with white balance adjustment for a plasma display panel (PDP).

BACKGROUND OF THE INVENTION

Due to the rapid development of multimedia applications, the user has a great demand for entertainment equipment. Conventionally, the cathode ray tube (CRT) display, which is a type of monitor, is commonly used. However, the cathode ray tube display does not meet the needs of multimedia technology because it occupies a large space. Therefore, many flat panel display techniques such as liquid crystal display (LCD) and plasma display panel (PDP) have been recently developed. These display techniques can manufacture a thin, light, short and small monitor, and thus these techniques are becoming the mainstream technology for the future. Of these techniques, the plasma display panel (PDP) is attracting attention in the field of displays as a full-color display apparatus having a large size display area and is especially popularly utilized in large size televisions or outdoor display panels. FIG. 1 shows an electrode structure of the plasma display panel according to the prior art.

An electrode structure includes a common electrode 100, a scan electrode 102 and barrier ribs 104, of which the common electrode 100 includes a narrow bus electrode 106 and a broad transparent electrode 108. The transparent electrode 108 has a constant width and contacts the bus electrode 106.

Due to an electrode structure with three primary colors, blue, red and green, the plasma display panel has varying luminance with respect to the three primary colors. Thus, the constant width 110 of the transparent electrode 108 results in a greater luminous difference between the three primary colors at a high brightness. Therefore, the display colors are imbalanced and impure.

The output gain of image signals is adjusted to correct the white balance of the plasma display panel. However, such an adjustment of output gain also simultaneously reduces the gray scale of the lower brightness, such as blue, so that the range of the gray scale is severely reduced causing a poor display. Additionally, the adjustment of the output gain of the image signals is still unable to control the luminance of the three primary colors by discharging simultaneously.

Consequently, how to improve a poor white balance due to inconsistency of the display is an important problem and is currently a main issue for plasma display panel manufacturers.

SUMMARY OF THE INVENTION

One object of the present invention is to utilize an electrode structure with white balance adjustment for a plasma display panel (PDP) to modify the differing luminance of the three primary colors in the luminant units by separating a transparent electrode from the main line of the comb electrode.

Another object of the present invention is to utilize an electrode structure with white balance adjustment for a plasma display panel (PDP) to adapt the differing luminance of the three primary colors in the ruminant units to obtain a preferred white balance by a plurality of steps of the transparent electrodes.

Still another object of the present invention is to utilize an electrode structure with white balance adjustment for a plasma display panel (PDP) to optimize the luminance and efficiency of the luminant units by reducing properly the step width of transparent electrodes.

According to the above objects, the present invention sets forth an electrode structure with white balance adjustment for a plasma display panel (PDP). The electrode is formed on the substrate and electrically couples with a signal generator to control the gas discharge of luminant units in a row. The electrode includes a comb electrode, a first transparent electrode and a second transparent electrode.

The comb electrode coupled to the signal generator has a main line and a plurality of branches outwardly perpendicular to the main line. The first transparent electrode is parallel to the main line of the comb electrode and electrically coupled to the branches of the comb electrode. The first transparent electrode has a plurality of steps having a variant width. The second transparent electrode is parallel to the main line of the comb electrode and electrically connects to the end portion of the branches of the comb electrode.

Specifically, the first transparent electrode is separated from the second transparent electrode and the comb electrode, respectively, to increase the flexibility of the transparent electrode by modifying the profile of the transparent electrode. For example, the profile of the first transparent along the branches of the comb electrode comprises a stepped or slanted profile. The width of the first transparent electrode is adjusted for the three primary colors of the luminant units to control the visible light through the first transparent electrode to acquire a preferred white balance.

More importantly, since the width of the transparent electrode corresponds to the three ruminant units, also known as a pixel, the plasma display panel can precisely adjust the display color of the ruminant units by controlling the brightness of the three luminant units for an improvement of the white balance.

In summary, the present invention provides an electrode structure with white balance adjustment to modify the differing luminance among the three primary colors in the ruminant units by separating the transparent electrode from the main line of the comb electrode. Further, using step and strip transparent electrodes combined with the comb electrode allows adjustment of the differing luminance of the three primary colors in the luminant units for a preferred white balance.

BRIEF DESCRIPTION OF THE DRAWINGS

The foregoing aspects and many of the attendant advantages of this invention will become more readily appreciated as the same becomes better understood by reference to the following detailed description when taken in conjunction with the accompanying drawings, wherein.

DETAILED DESCRIPTION OF THE PREFERRED EMBODIMENT

The present invention is directed to an electrode structure with white balance adjustment for plasma display panel (PDP) to improve the shortcomings of a conventional PDP used in the prior art. The electrode structure with white balance adjustment is able to modify the differing luminance among the three primary colors in the luminant units by separating the transparent electrode from the main line of the comb electrode. Further, using step and strip transparent electrodes combined with the comb electrode allows adjusting the differing luminance of the three primary colors in the luminant units to obtain a preferred white balance. The present invention is suitable for a variety of transparent electrodes, such as comb or strip electrodes.

Figure 1:
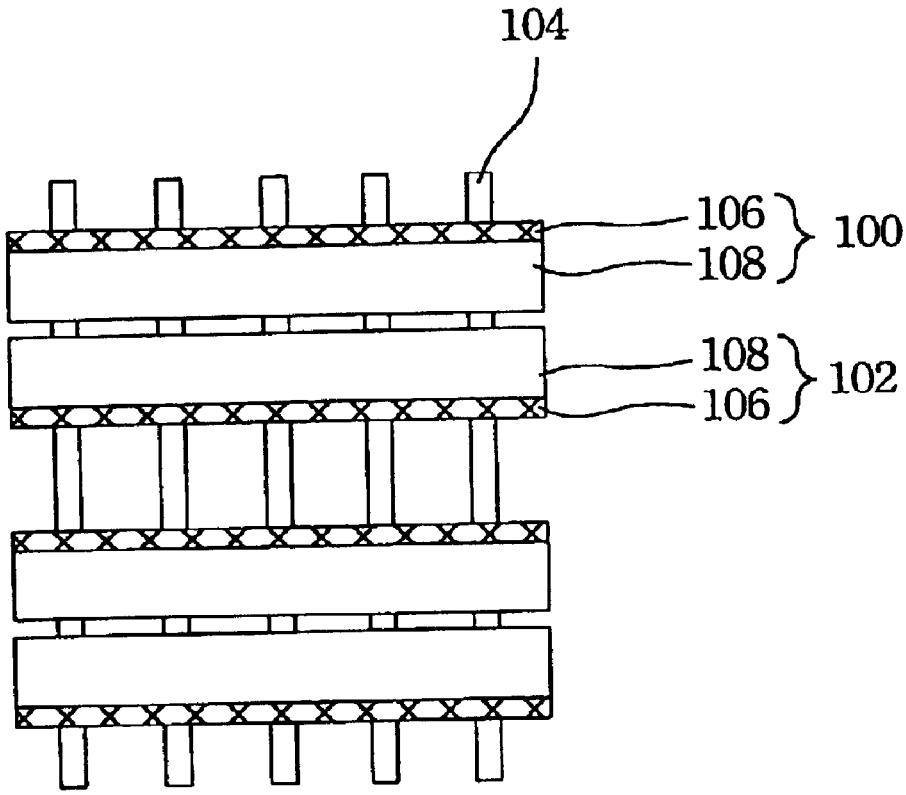
FIG. 1 (PRIOR ART)
FIG. 1 illustrates an electrode structure of a conventional plasma display panel.
Figure 2:
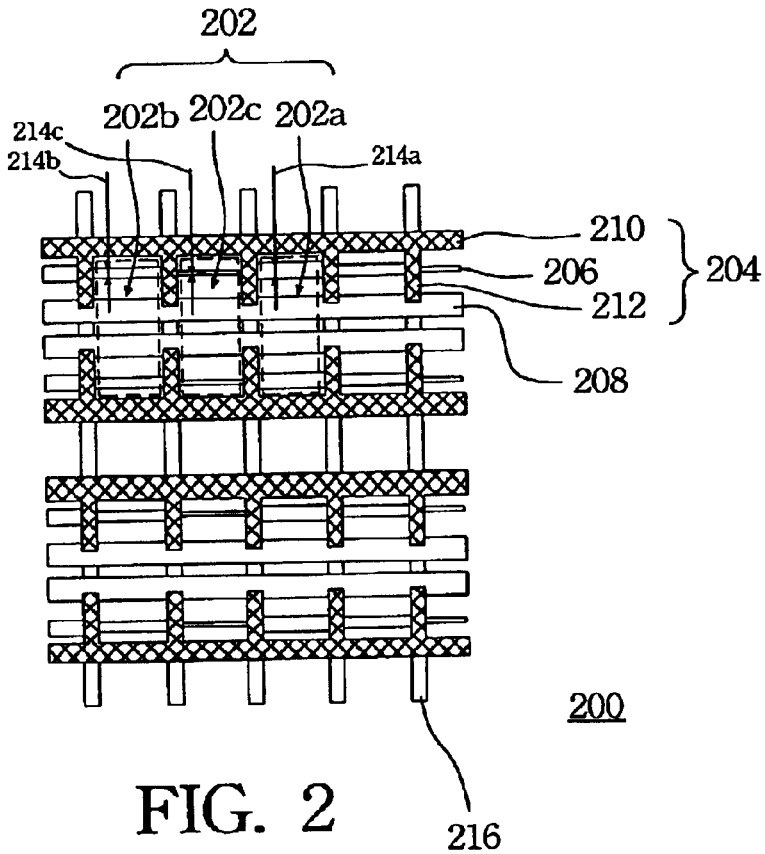
FIG. 2 illustrates a top view of an electrode structure having a step electrode and a strip electrode combined with a comb electrode according to a preferred embodiment of the present invention.

FIG. 2 shows a top view of an electrode structure having a step transparent electrode and a strip transparent electrode combined with a comb electrode according to a preferred embodiment of the present invention. The electrode structure 200 with white balance adjustment for a plasma display panel is formed on a substrate and connected to a signal generator to control a gas discharge of a plurality of luminant units 202*a*, 202*b*, 202*c* in a row. The electrode structure 200 comprises a comb electrode 204, a first transparent electrode 206 and a second transparent 208.

The comb electrode 204 coupled with the signal generator has a main line 210 and a plurality of branches 212 perpendicular to the main line 210. The first transparent electrode 206 is parallel to the main line 210 of the comb electrode 204 and electrically coupled to the branches 212 of the comb electrode 204. The second transparent electrode 208 parallels the main line 210 of the comb electrode 204 and is electrically coupled to the end portion of the branches 212 of the comb electrode 204. Further, the first transparent electrode 206 is separated from the second transparent electrode 208. The first transparent electrode 206 has a plurality of steps having a variant width according to the primary colors.

Specifically, the first transparent electrode 206 is separated from the second transparent electrode 208 and the comb electrode 204, respectively, to increase the flexibility of the transparent electrodes 206, 208 by changing the profile of the transparent electrode. For example, the profile of the first transparent 206 along the branches 212 of the comb electrode 204 comprises a stepped or slanted profile. The width of the first transparent electrode 206 located on the ruminant units 202*a*, 202*b*, 202*c* of blue, red and green is defined as $W_B$, $W_R$ and $W_G$, respectively. The adjustment of the $W_B$, $W_R$ and $W_G$ 214*a*, 214*b*, 214*c* corresponds to the luminant units 202*a*, 202*b*, 202*c* of the three primary colors.

On the basis of the differing luminance of the three primary colors, the first transparent electrode 206 is adjusted so that an inequality, $W_B>W_R>W_G$, is obtained to control the visible light through the first transparent electrode 206 and to achieve a preferred white balance. More importantly, since the $W_B$, $W_R$ and $W_G$ 214*a*, 214*b*, 214*c* correspond to the three luminant units 202*a*, 202*b*, 202*c* which are defined as a pixel, the plasma display panel can precisely adjust the display of the pixel by controlling the brightness of the three luminant units 202*a*, 202*b*, 202*c* for an improvement of the white balance.

In the present invention, the electrode structure also comprises a plurality of barrier ribs 216 formed on the substrate to avoid a mixture of the three primary colors. In addition, both the first and the second transparent electrode 206, 208 cover the main line 210 and the branches 212 of the comb electrode 204. The material of the first and the second transparent electrode 206, 208 comprises a semiconductor, such as a mixture of indium oxide $In_2O_3$ and tin oxide $SnO_2$(ITO).

The plasma display panel uses three-electrode, a common electrode, a scan electrode and a data electrode. The structure of the common electrode and the scan electrode is described as the electrode structure 200 and the common electrode is opposite the scan electrode on the substrate. The first and the second transparent electrodes 206, 208 located in a same row of luminant units and combined with the comb electrode maintain the discharge or switch of the luminant units 202*a*, 202*b*, 202*c* when a voltage is applied to the sidewall of the data electrode.

Due to a first transparent electrode 206 between the main line 210 and branches 212 of the comb electrode 204, the branches 212 of the comb electrode 204 with high electric conductivity are used to increase electric conductivity of the transparent electrode 206, 208. A uniform electrical field is thus generated in the ruminant units 202*a*, 202*b*, 202*c* to introduce regular ultraviolet (UV) rays resulting in an increase of the discharge efficiency.

Figure 3:
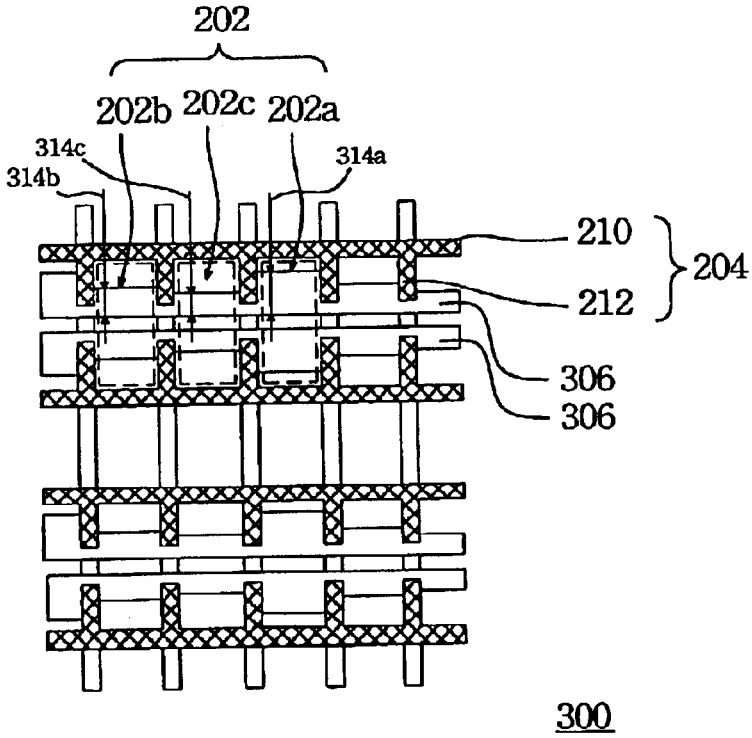
FIG. 3 illustrates a top view of an electrode structure having a step electrode combined with a comb electrode according to another preferred embodiment of the present invention.

FIG. 3 shows a top view of an electrode structure having a step electrode combined with a comb electrode according to another preferred embodiment of the present invention. The electrode structure 300 with white balance adjustment for plasma display panel is formed on a substrate and connected to a signal generator to control a gas discharge of a plurality of luminant units at a row. The electrode structure 300 comprises a comb electrode 204 and a transparent electrode 306.

The comb electrode 204 coupled to the signal generator has a main line 210 a plurality of branches 212 perpendicular to the main line 210. The transparent electrode 306 parallel to the main line 210 of the comb electrode 204 is electrically coupled to the end portion of the branches 212 of the comb electrode 204. Further, the transparent electrode 306 is separated from the main line 210 of the comb electrode 204.

Specifically, the transparent electrode 306 is separated from the comb electrode 204 to increase the flexibility of the transparent electrode 306 by changing the profile of the transparent electrode 306. For example, the profile of the transparent electrode 306 along the branches of the comb electrode 204 has a stepped or slanted profile. The width of the transparent electrode 306 located on the luminant units 202*a*, 202*b*, 202*c* of blue, red and green is defined as $W_B$, $W_R$ and $W_G$ 314*a*, 314*b*, 314*c*, respectively. On the basis of the differential luminance among the three primary colors, the transparent electrode 306 is adjusted so that an inequality, $W_B>W_R>W_G$ 314*a*, 314*b*, 314*c* is obtained to control the visible light through the transparent electrode 306.

More importantly, since the $W_B$, $W_R$ and $W_G$ 314*a*, 314*b*, 314*c* correspond to the three luminant units 202*a*, 202*b*, 202*c* which are defined as a pixel, the plasma display panel can precisely adjust the color display of teach pixels by controlling the brightness of the three ruminant units 202*a*, 202*b*, 202*c*.

Although a large region of the transparent electrode obtains a high luminance, the efficiency of the ruminant units 202*a*, 202*b*, 202*c* can be reduced. In the preferred embodiment of the present invention, the driving current for discharge maintenance is effectively decreased while the area of the transparent electrode is reduced to lessen the power consumption of the plasma display panel. Consequently, the electrode structure applied in the ruminant units with high luminance utilizes a step transparent electrode to replace the constant width of the transparent electrode to balance the luminance of the three primary colors. Moreover, a proper decrement of the transparent electrode is allowed to increase luminous efficiency so that both the luminance and efficiency of the ruminant units are optimized.

According to the above-mentioned, the present invention utilizes an electrode structure with white balance adjustment to modify the differential luminance among the three primary colors in the ruminant units by separating the transparent electrode from the main line of the comb electrode. Further, using step and strip transparent electrodes combine to the comb electrode allows adjustment of the differing luminance among the three primary colors in the ruminant units to obtain a preferred white balance.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. An electrode structure with white balance adjustment for a plasma display panel, the electrode structure being formed on a substrate and connected to a signal generator to control a gas discharge of a plurality of luminant units in a row, the electrode structure comprising:

a comb electrode coupled to the signal generator and having a main line and a plurality of branches perpendicular to the main line;

a first transparent electrode parallel to the main line of the comb electrode and electrically coupled to the branches of the comb electrode and having a strip covering the main line and the branches of the comb electrode; and a second transparent electrode parallel to the main line of the comb electrode and electrically coupled to an end portion of the branches of the comb electrode, the first transparent electrode being separate from the second transparent electrode.

2. The electrode structure of claim 1, wherein the first transparent electrode along the branches of the comb electrode comprises a plurality of steps.

3. The electrode structure of claim 1, wherein three widths for blue, red and green of the first transparent electrode along the branches comprises $W_B$, $W_R$ and $W_G$ with a differential width, respectively.

4. The electrode structure of claim 3, wherein the differential width comprises an inequality of $W_B > W_R > W_G$.

5. The electrode structure of claim 1, further comprising a plurality of barrier ribs formed on the substrate.

6. The electrode structure of claim 1, wherein the second transparent electrode comprises a strip covering the main line and the branches of the comb electrode.

* * * * *